United States Patent [19]

Basson

[11] Patent Number: 5,001,460

[45] Date of Patent: Mar. 19, 1991

[54] SYSTEM FOR PROTECTING PORTABLE ARTICLES SUCH AS CASES AND HANDBAGS FROM UNAUTHORIZED USE

[75] Inventor: Nissim Basson, Bat-Yam, Israel

[73] Assignee: A.B.N. Trap Alarm Systems Ltd., Jaffa, Israel

[21] Appl. No.: 313,444

[22] Filed: Feb. 22, 1989

[30] Foreign Application Priority Data

Feb. 24, 1988 [IL] Israel ..... 85317

[51] Int. Cl.[5] ..... G08B 13/14

[52] U.S. Cl. ..... 340/571; 340/691; 340/539

[58] Field of Search ..... 340/571, 691

[56] References Cited

U.S. PATENT DOCUMENTS

| | | | |
|---|---|---|---|
| 4,117,468 | 9/1978 | Vasquez | 340/571 |
| 4,591,835 | 5/1986 | Sharp | 340/571 |
| 4,804,943 | 2/1989 | Soleimani | 340/571 |

FOREIGN PATENT DOCUMENTS

| | | | |
|---|---|---|---|
| 3345463 | 6/1985 | Fed. Rep. of Germany | 340/571 |
| 2108303 | 5/1983 | United Kingdom | 340/571 |
| 2132804 | 7/1984 | United Kingdom | 340/571 |

*Primary Examiner*—Donald O. Woodiel
*Assistant Examiner*—Geoff Sutcliffe
*Attorney, Agent, or Firm*—Dennison, Meserole, Pollack & Scheiner

[57] ABSTRACT

A system for protecting portable articles from unwanted use. The system includes a portable transmitter external to the article for transmitting coded signals of fixed radio frequency pulses to an electronic mechanism installed in the article. The mechanism includes a mode selector for operating the system in a first, second or third mode. There is also a device for activating an electronic flash, an alarm or other similar protective mechanisms during any of the modes, and a device for neutralizing the activating device.

16 Claims, 4 Drawing Sheets

1
2
3
4
5
6

31
32
33
34
35
36
37
38
39
40

11
12
13
14
15

41
12
43

43

Fig. 9.
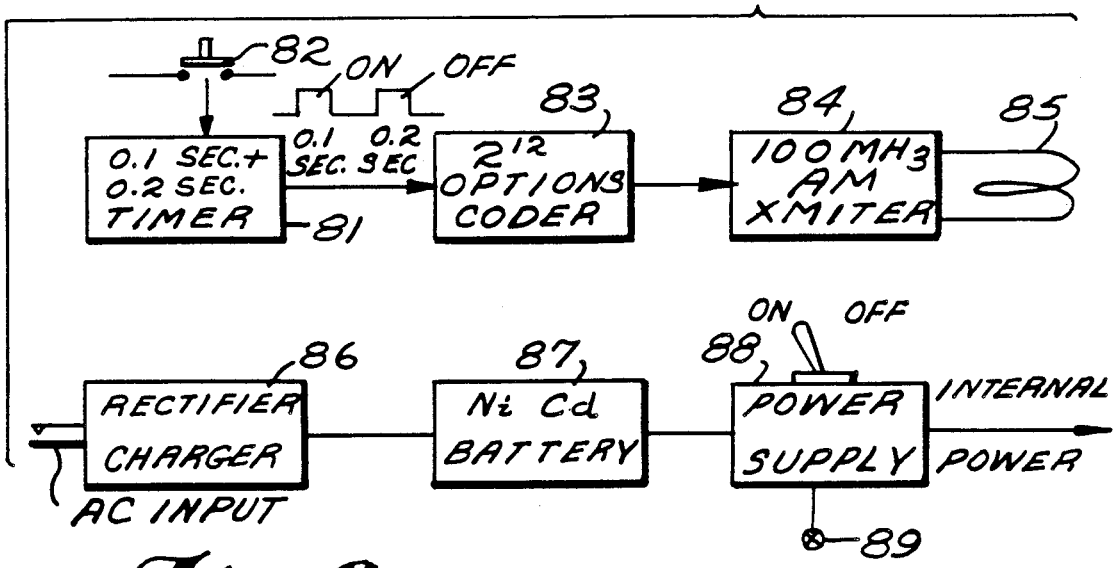
Fig. 8A.
Fig. 8B.
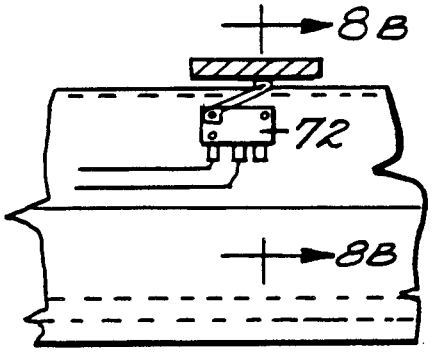
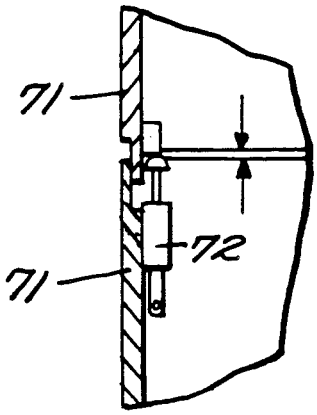
Fig. 7.
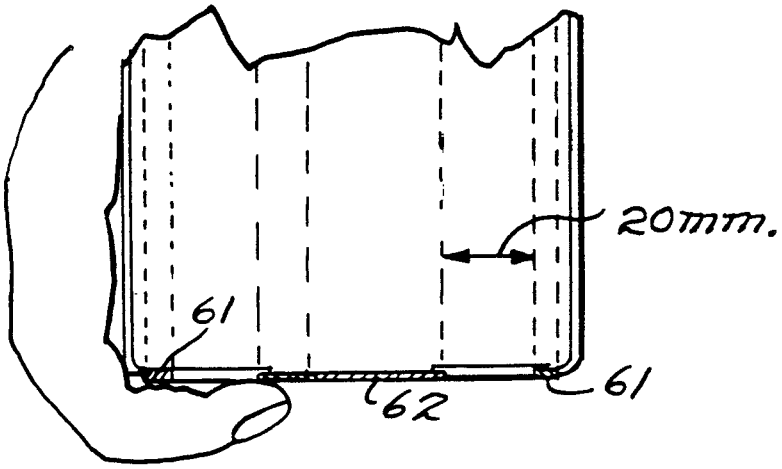

SYSTEM FOR PROTECTING PORTABLE ARTICLES SUCH AS CASES AND HANDBAGS FROM UNAUTHORIZED USE

BACKGROUND OF THE INVENTION

The present invention relates to a system for protecting portable articles such as handbags and suitcases from unauthorized use.

Specifically, the invention relates to a system for protecting portable articles comprised of a portable transmitter and an electronic mechanism installed in the article and including sensing components, alarm components, and protective components.

Theft of handbags, suitcases and other portable articles is very common all over the world, and there is an increasing need for systems to protect these articles from unauthorized use. Particularly, there is a need for protection from theft and purse-snatching in the case of the elderly residing in isolated areas, and also in the case of transference of sensitive material such as jewels, cash, other valuables, or important documents.

Today, many persons who must transfer such goods protect themselves by the use of metal handcuffs attached to the case's handle and to the bearer's hand. Such a form of protection constitutes only limited protection from purse-snatchers and thieves. The bearer is both exposed to the danger of theft which is not premeditated, and incurs inconvenience, inasmuch as the handcuffs attract unnecessary attention. The fact that the case is attached to the bearer's wrist makes it impossible to transfer it from hand to hand when necessary.

In the event that the thief decides to attack the bearer despite the handcuff, he will do so violently in order to allow himself sufficient time in which the bearer is unable to resist, in order to detach the handcuff.

The protective mechanisms in the present invention operate with the aid of a transmitter, and allow the bearer to transfer the case from one hand to the other as necessary.

Other anti-theft protective mechanisms operate on the principle of an alarm which is set off when the case is opened. Many of these are characterized by a disadvantage whereby the alarm mechanism is not activated unless the case is opened, and thus does not prevent theft of the case. (See, for example, Israeli Pat. No. 46215). An additional disadvantage lies in the fact that the alarm mechanism in and of itself often does not deter the thief from quickly snatching the valuables in the case and escaping.

SUMMARY OF THE INVENTION

The present invention relates to a system for protecting portable articles from unauthorized use which is comprised of a portable transmitter external to said article and an electronic mechanism installed in the article, with the transmitter transmitting signals at fixed radio frequency pulses, received by a receiver in the electronic mechanism in the article thus preventing the operation of the protective mechanism, and setting into operation electric shock mechanisms and/or a flashing light and/or an alarm mechanism, when the signals from the transmitter are not received or are received with insufficient intensity, or when the case is opened by an unauthorized person.

The purpose of the present invention is to supply the bearer of the portable article (such as a handbag or suitcase) with more convenient and more effective protection from attack or theft by combining elements of alarm and protection systems. The above goal is achieved by integrating three elements:

A. Startling the assailant by means of high voltage electrical shocks (about 20,000 volts) so that he will discard the article;

B. Operation of a powerful siren to startle the assailant and attract the attention of others, thus hastening the assailant's retreat;

C. Operation of a powerful flashing light which blinds the assailant and stuns him and which attracts the attention of passers-by.

The article used to illustrate the present invention is an attache case (hereinafter referred to as the "protective case") having no external signs to disclose its special features. The protective case operates in three ways which prevent its theft:

A. Active/manual operation which is initiated by the bearer.

B. Passive/automatic operation which is set off automatically under certain conditions, if the bearer is incapacitated as a result of the assailant's violence, or if the protective case is stolen without the bearer's awareness of the theft.

C. If the protective case is opened without the mechanism having been neutralized, the protective mechanism will automatically be set into operation.

The protective case has three modes of operation from which the bearer chooses the mode he desires. These modes will be explained in detail in the description of the figures. The bearer can operate or neutralize the protective mechanisms of the protective case by use of a key, external to the case. The electronic parts which comprise the protective system of the protective case are operated by a battery with sufficient capacity to enable continuous operation of the sensing and protective mechanisms for 15 minutes, and continuous operation of the sensing mechanism for 36 hours. Even if the protective case is opened in the presence of others, its unique features can not be detected, inasmuch as the components of its mechanisms are camouflaged and hidden. The loss of capacity to the case is minimal, and the system and the battery which operates it are located in a part of the case not usually utilized. Other features, aspects and advantages of the present invention will be apparent when the detailed description is presented with the accompanying figures.

BRIEF DESCRIPTION OF THE DRAWINGS

The present invention is herein described by way of example only, with reference to the accompanying figures wherein:

FIG. 7: Peripheral shock strips.

FIG. 8*a*: Micro-switch.

FIG. 8*b*: Sectional view along line A—A of FIG. 8*a*.

FIG. 9: Block diagram of the transmitter.

DESCRIPTION OF THE PREFERRED EMBODIMENT

Figures 1, 2, 4, 5A, 5B:
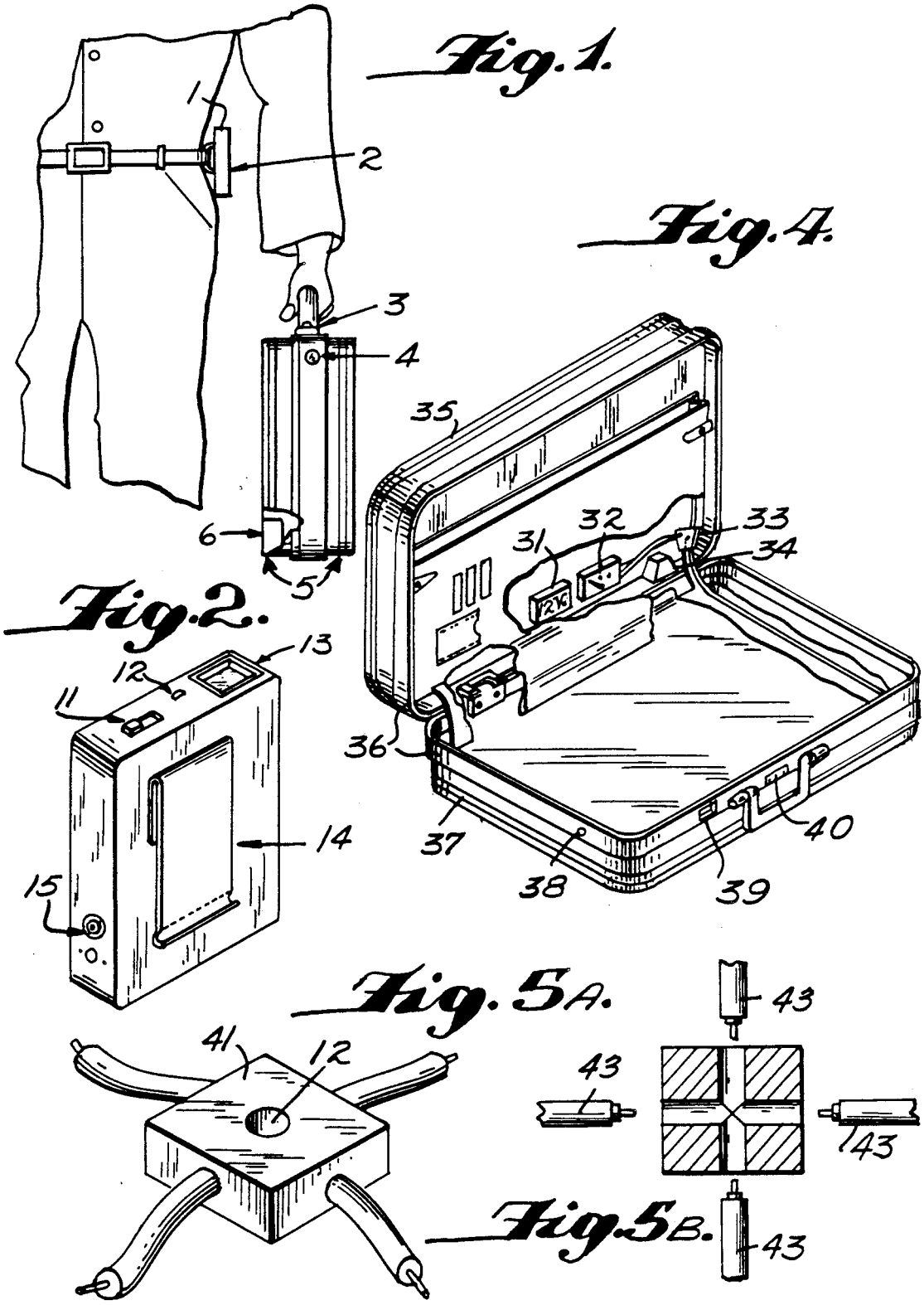
FIG. 1: A general picture of the location of the invention's mechanisms.
FIG. 2: The transmitter (external view).
FIG. 4: Internal view of the protective case.
FIG. 5*a* and 5*b*: High voltage distributor in plan and exploded views, respectively.

In FIG. 1 it can be seen that as part of the protective case's protective mechanism there is an instrument resembling a beeper 1 attached to the bearer's belt or kept in his pocket. In essence, this is a device which transmits a coded signal received by the mechanism 6 in the protective case within a range of 5–10 meters. Said mechanism decodes the signal and neutralizes the mechanism. The coding capacity of the transmitter/receiver reaches $2^{12}$ different possibilities, when the transmission/reception is in the frequency range of 100 MHz. According to a preferred embodiment, the transmitter is operated every 0.3 seconds for the duration of 0.1 seconds. This transmission serves to prevent the operation of the alarm, shock and flash mechanisms for the duration of 2 seconds.

The mechanism of the present invention is adapted for three operational modes of action. In its passive/automatic action, that is when the case is stolen, after the assailant moves 5–10 meters away, or in any other instance where the case is moved more than 5–10 meters away from the transmitter, the receiver in the case will no longer receive the coded signal with sufficient intensity and the mechanism will operate automatically according to the selected mode. In its active/-manual action the bearer of the case presses a special switch 13 which is recessed in the transmitter and sets off the mechanism's immediate operation, even at closer range than 5–10 meters. Actually, the pressing of the switch stops transmission and thus the mechanism in the case is put into operation. In the third mode of action, if the case is opened without having been neutralized by the appropriate key in electric lock 4, the mechanism in the case will be operated by the selected mode.

The "regular mode": In this mode, the siren will operate two seconds after the termination of reception of the coded signals and two seconds later the electric shock mechanism and the electric flash will operate. The interval between the operation of the siren and the electric shock allows the bearer of the protective case to put it down in the event of a "false alarm" and to neutralize it by means of the electric lock which is set in the case's safe area (details will follow).

"Brave mode": In this mode of operation, the siren, the electric shock mechanism and the flash operate simultaneously and thus intensify the shock which the assailant receives.

"Alarm mode": When this mode is selected, only the siren mechanism is operated.

The electric shock mechanism is a mechanism for creating high voltage pulses (about 20,000 volts) at a rate of between 5–7 pulses per second while flashing a powerful light, such that when the high voltage pulses discharge through the assailant's hand, he will experience convulsions and pain causing him to drop the protective case immediately. The electric shock mechanism is disigned for discharge trajectories which will shock the holder of the protective case regardless of the way in which he is carrying it, including through the handle 3, or shock strips 5, for when the case is carried under the bearer's arm.

As is evident from FIG. 1, the operating/neutralizing lock 4 of the protective case is located on the case's central metal frame which is at low potential, and thus there is no danger involved if the case's owner touches it.

FIG. 2 describes the transmitter's exterior. The transmitter can be suspended on a belt by means of a special spring 14 or carried in one's pocket. It has a rechargeable battery whose charge socket 15 is external. If the battery is weak, a bulb 12 lights up, denoting "low voltage". The transmitter has an operating switch 11 (on/off) which disconnects the battery and thus prevents its weakening when the system is not in use. For active operation there is a switch 13 on the top of the transmitter (which is recessed in order to prevent inadvertant operation) which stops the transmission of signals for about 5 seconds after the switch is pressed, in which time the protective case operates automatically.

Figure 3:
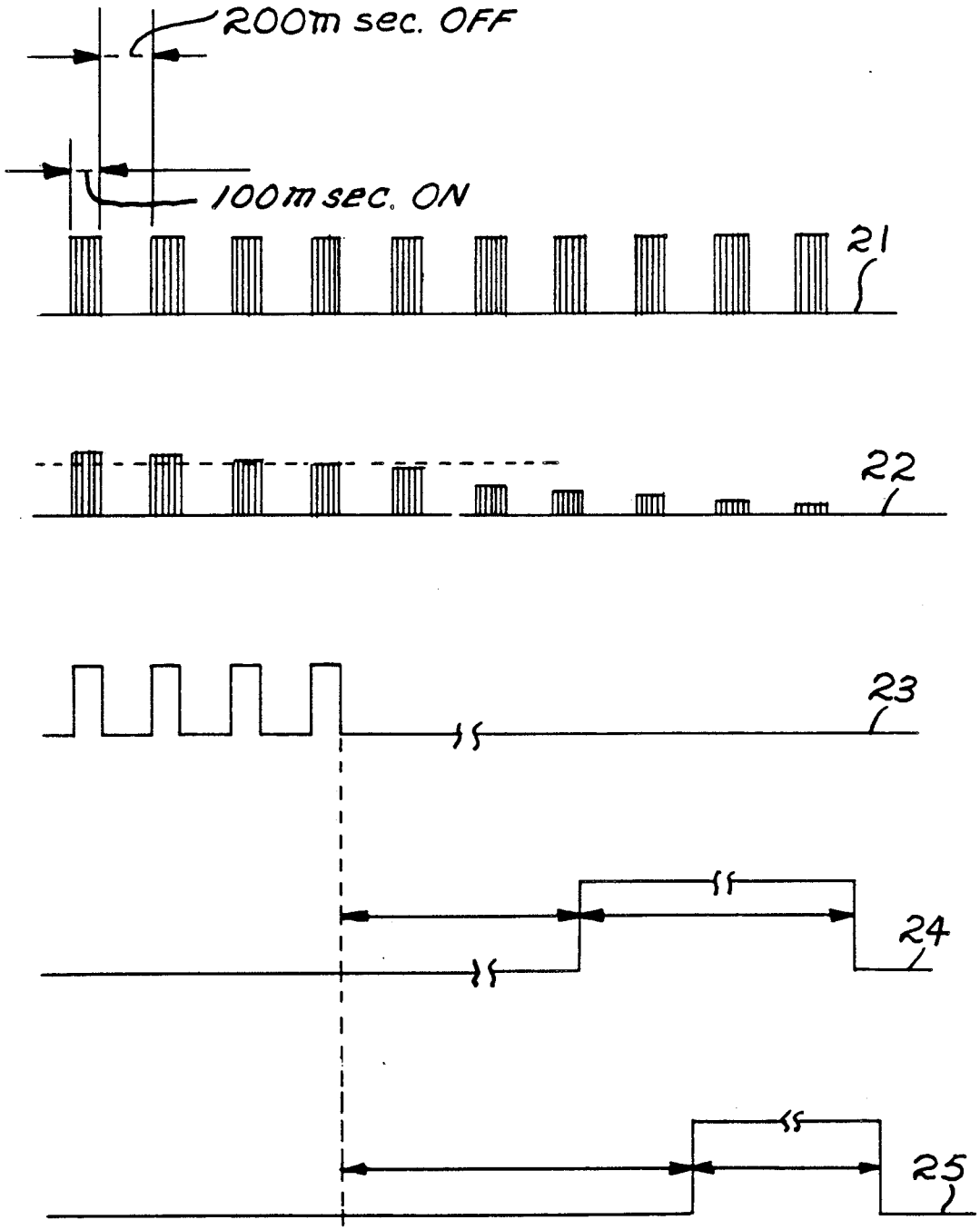
FIG. 3: Graphs presenting the timing and intensity of the signals (transmission/reception).

FIG. 3 describes the signals and their timing at transmission and reception, with Graph 21 presenting the timing of the transmitting signals and Graph 22 the intensity of the signals received, while the dotted line represents the sensitivity threshold of the receiver as the distance between the receiver and the transmitter increases. In addition, FIG. 3 shows blanking pulses (Graph 23), the signal for the siren's operation (Graph 24) and the signal for the operation of the shock and flash (Graph 25).

FIG. 4 describes the protective mechanism in the protective case. The electronic mechanism 32 is installed behind the document pocket which is usually not used, and thus effective space in the protective case is not wasted nor is the mechanism revealed when the case is opened.

The central frame of the protective case 36 is comprised of two parts attached to the potential (−) of the battery 31, which is the lowest electric potential in the case. Thus electric sparks will seek to discharge towards it.

Inasmuch as the mechanism in the case creates a voltage of about 20,000 volts, in planning the case, the shock points 40 in the handle and the peripheral shock strips 35, 37 should be placed about 20 millimeters from the frame in order to cause the discharge of the pulses to the negative potential of the battery and to create high voltage sparks (according to the breakdown voltage of about 10,000 volts per 10 millimeters in the air).

The high voltage reaches the peripheral shock strips 35 and 37 and the shock points in the handle 40 via high voltage wires with reinforced insulation. The voltage reaches the high voltage wires via an insulating splitter 33. These wires are soldered to each other inside the splitter.

FIGS. 5*a* and 5*b* show an example of such an insulating splitter. The splitter comprises four high voltage cables 43 which are soldered together without interfering with the insulation. This is accomplished by manufacturing a cube-shaped insulating splitter 41 made of a plastic insulating material according to the protective case's dimensions.

If the case's owner wishes to neutralize the mechanism, or if the shock mechanism is put into operation, the key-operated lock 38 located on the frame should be used. Near the case's handle, the electric flash 39 is installed and operates as described above. The inner siren 34 is also installed behind the document pocket, and at the bottom of the case there are apertures (not shown) which allow the siren to be heard.

Figures 6, 10:
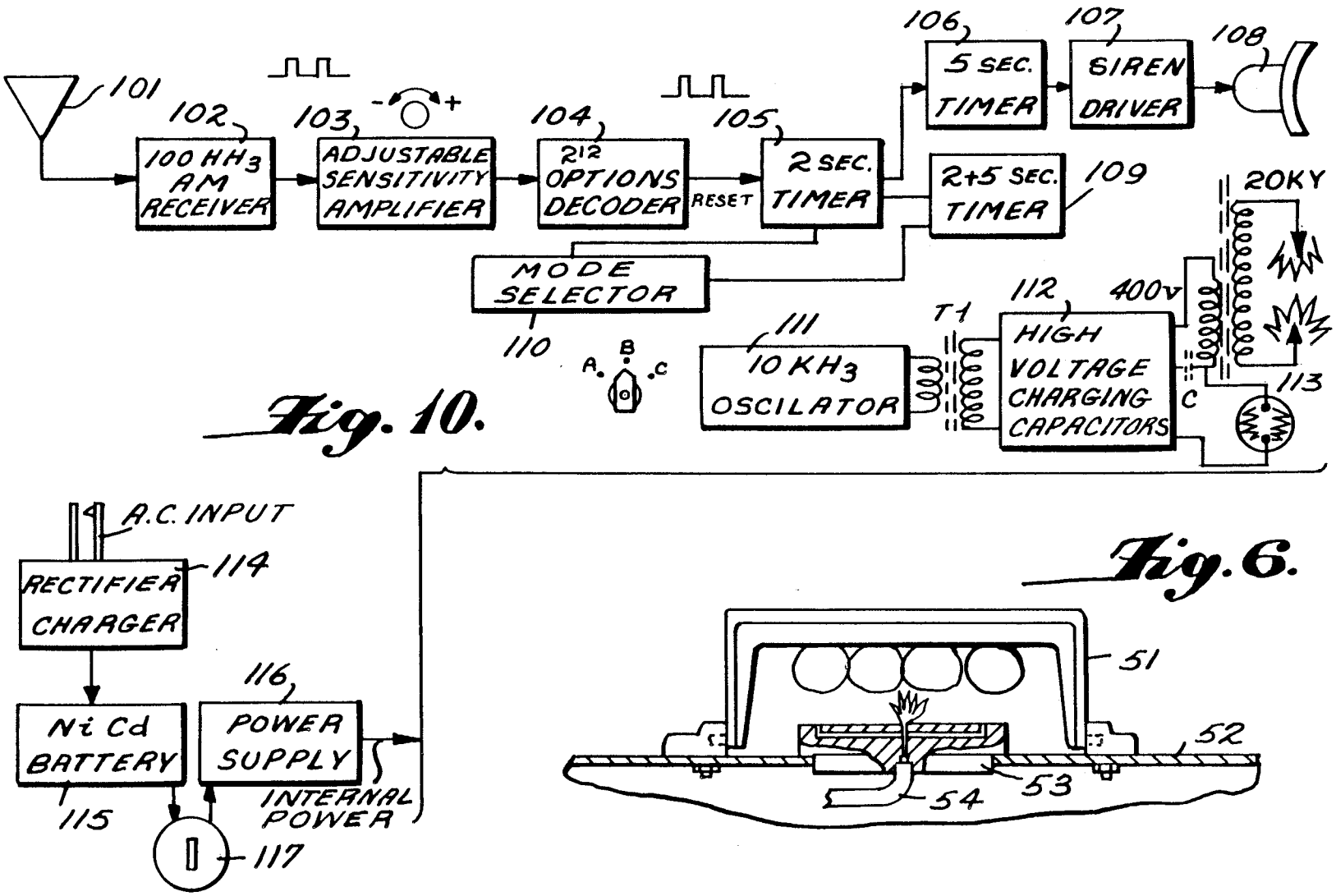
FIG. 6: Handle of the protective case.
FIG. 10: Block diagram of the electronic mechanism in the protective case.

FIG. 6 describes the protective action when the handle is in the assailant's hands. In designing the protective case, a space should be left such that when the handle is held, a small space is created between the fingers of the hand gripping the handle and the shock points.

Through this space, the high voltage is discharged in a spark which passes through the hand to the handle 51 (which, along with the metal frame 52 is at (−) potential).

FIG. 7 illustrates the peripheral shock strips 61 which must be at a distance of about 20 millimeters from the metal frame 62 of the protective case. The shock strips must be attached to their high voltage wires, and thus an attachement must be made to a blind rivet (not shown), to which the wires will be attached. It is desirable to design the peripheral shock strips in such a way that they do not protrude and will even be decorative.

Adjacent the opening portion of the protective case, a micro-switch is installed which sets the mechanism into operation when the case is opened (shown in detail in FIG. 8). FIG. 8 illustrates the micro-switch 72 installed in the interior of the front of the case's frame 71 and which operates the protective mechanism as soon as the protective case is opened. The micro-switch should be placed in such a way that opening the protective case 3–4 millimeters will set it into operation.

FIG. 9 presents a schematic description of the transmitter's action. As long as the recessed switch 82 is not pressed, the timer unit 81 creates a series of pulses whereby in $\frac{1}{3}$ of the time, the transmission is active and in $\frac{2}{3}$ of the time, the transmission is not (200 mSec not active, 100 mSec active).

The coder unit 83 creates one code of $2^{12}$ coding possibilities (tailored to each individual protective case).

The coded signal contains up to 12 code pulses and modulates an AM transmitter in the frequency range of 100 MHz (84) and at a low output of about 0.25 Watt.

An aerial 85 is built into the transmitter. The charger/rectifier 86 charges and rectifies the 9-volt nickel cadmium battery 87 which constitutes a source of power to the transmitter. The internal power supply 88 receives its power from the nickel cadmium battery and supplies voltage to the transmitter's circuit and contains an electric circuit to detect a drop in the battery's voltage 89 and operate an LED to indicate the failure.

FIG. 10 illustrates schematically the operation of the protective case's mechanism. The transmitted pulses (at fixed time intervals) are received in the protective case in a transistor reception unit 102 (AM Receiver) which is set to a frequency range of 100 MHz and attached to the external aerial 101, to circuits of 30 centimeters length. The receiver receives the RF signal and reveals the coded signal. After the coded signal is revealed, it is transferred to an amplifier unit 103 whose sensitivity can be adjusted in a laboratory, so that a signal transmitted from a distance of more than 5–10 meters will set the protective case's protective mechanism into operation.

The amplified signal which has broken down the sensitivity threshold, is sufficiently defined and powerful, and the decoder 104—if tailored to the same code as the portable transmission unit—will transfer a signal which indicates identical codes. The signal received every 300 mSec (if the transmitter is operating from an appropriate range) resets the 2 sec timer 105 which searches for the signal for two seconds. If no coded signal is detected for two seconds, the siren mechanism 107 and 108 will operate with the aid of the 5 sec timer 106, and two seconds later, the shock mechanism 111, 112, 113 will operate with the aid of the timing unit 109 (2 and 5 sec timer) for five seconds (depending on the mode of operation).

The operating mode is determined by a 3-state mode selector 110 which controls the various timing units and the sequence of their operation. When a signal exists for the operation of the shock and flash mechanisms, a low voltage 10 KHz oscillator is set into operation which, by means of a step-up transformer T1 charges high voltage charging capacitors 112 up to a breakdown voltage of the electric flash 113. Breakdown voltage of an electric flash (based on a neon bulb) is about 400 volts, so that when the voltage on the capacitors reaches this voltage, the flash is set into operation and discharges the capacitors' voltage. Thus the 10 KHz oscillator actually recharges the capacitors, with the charging speed determining the pace of the high voltage sparks. With the discharge of voltage in the flat, the transformer T2 transfers the energy from the primary to the secondary induction coil, and due to the transformation unit ratio, a voltage of approximately 20,000 volts is created.

The role of the capacitor c adjacent to the flash is to cause (during the voltage discharge in the primary induction coil of T2) oscillations by which energy can be conveyed to the secondary coil. In addition, in the protective case there is a rectifier/charger 114 which charges the nickel cadmium battery 115. The electric key 117 actually cuts off the power from the power supply 116 and thus from the circuits of the protective case's mechanism.

It should be understood by those skilled in the art that many other variations and modifications may be made in the present invention without departing from the spirit and scope thereof as described in the specification and defined in the appended claims.

I claim:

1. A system for protecting portable articles having an inner portion and an outer surface from unwanted use comprising:

a portable transmitter external to said article and adapted to transmit coded signals comprised of fixed ratio frequency pulses;

an electronic mechanism installed in the article for receiving the transmitted coded signals comprised of fixed radio frequency pulses, said electronic mechanism including mode selector means for operating said electronic mechanism in a first, second or third mode, means for activating at least one of the following protective mechanisms during any of said modes, an electronic shock mechanism for creating high voltage pulses, an electric flash mechanism for emitting a powerful flashing light, and an alarm means for outputting loud signals;

means for neutralizing said activating means accessibly positioned on the outer surface of the article;

means attached to the outer surface for carrying said article; and wherein said electronic mechanism includes:

electronic shock points connected to said electronic shock mechanism and mounted to said outer surface near said carrying means for delivering said high voltage pulses to said carrying means during said first and second modes;

a plurality of shock strips connected to said electric shock mechanism and mounted on the outer surface of said article for delivering said high voltage pulses to said outer surface during said first and second modes; and an electric flashing light connected to said electric flash mechanism and mounted on the outer surface of said article for delivering said powerful flashing light.

2. A system according to claim 1 and wherein said means for neutralizing comprises a radio receiver disposed in the article and adapted to receive the transmitted signals and generate an output signal in response thereto, and means operative in response to said output signal for preventing activation of said protective mechanism.

3. A system according to claim 1 and wherein said means for neutralizing comprises a switch disposed in said transmitter for manual halting of transmission.

4. A system according to claim 1 and wherein said means for activating comprises means for manual activation of said at least one protective mechanism.

5. A system according to claim 2 and wherein said means for activating are operative to activate said protective mechanism when said signals are not received by said receiver with sufficient intensity.

6. A system according to claim 1 and wherein said means for activating are operative to activate said protective mechanism automatically when the article is moved to a distance greater than 5 to 10 meters from the transmitter.

7. A system according to claim 1 and wherein said means for activating are operative to activate said protective mechanism when said article is opened.

8. A system according to claim 1, wherein said neutralizing means includes key-operated means for activting or neutralizing the protective mechanism, said key-operated means being disposed in the exterior of said article.

9. A system according to claim 8 and wherein said key-operated means is disposed on a central metal frame of the article.

10. A system according to claim 2 wherein said transmitter transmits said coded signal in a frequency range centered around 100 MHz and said radio receiver is operative to determine whether the received signal is a properly coded signal.

11. A system according to claim 1 and wherein said means for activating is operative in said first mode to activate first said alarm means and thereafter said electric shock mechanism and said electric flash mechanism.

12. A system according to claim 1 and wherein said means for activating is operative in said second mode to activate said alarm means, said electric shock mechanism and said electric flash mechanism simultaneously.

13. A system according to claim 1 and wherein said electric shock mechanism creates said high voltage pulses (of at least 20,000 Volts) at a rate between 5 and 7 pulses per second.

14. A system according to claim 1 and further comprising a micro-switch disposed in the article and arranged to activate the protective mechanism when the article is opened.

15. A system according to claim 1, wherein said means for activating is operative in said third mode to activate said alarm mechanism.

16. A system according to claim 1, wherein said means for carrying said article is a handle.

* * * * *